US005567563A

United States Patent [19]

Minami

[11] Patent Number: 5,567,563

[45] Date of Patent: Oct. 22, 1996

[54] TONER BINDER COMPOSITION AND TONER COMPOSITION

[75] Inventor: Tohru Minami, Kyoto, Japan

[73] Assignee: Sanyo Chemical Industries, Ltd., Kyoto, Japan

[21] Appl. No.: 482,543

[22] Filed: Jun. 7, 1995

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 5,176,978 | 1/1993 | Kumashiro et al. | 430/110 |
| 5,225,303 | 7/1993 | Tomita et al. | 430/110 X |
| 5,229,242 | 7/1993 | Mahabadi et al. | 430/110 X |

OTHER PUBLICATIONS

Database WPI, Derwent Publications, AN 92–353661, JP–A–4 255 865, Sep. 10, 1992.
Database WPI, Derwent Publications, AN 94–129241, JP–A–6 075 422, Mar. 18, 1994.
WPAT, AN 93–340697/43, US–A–5,384,224, Jan. 24, 1995.
WPAT, AN 92–013775/02, US–A–5,244,765, Sep. 14, 1993.
WPAT, AN N94–256124, EP–A–621511, Oct. 26, 1994.

*Primary Examiner*—Roland Martin
*Attorney, Agent, or Firm*—Oblon, Spivak, McClelland, Maier & Neustadt, P.C.

[57] ABSTRACT

Toner binder compositions for electrophotography, comprising a binder resin (A) and an organic material (B) dispersed therein with an average particle size of not more than 5 μm at roan temperature; said material (B) being compatible with (A) between 80°~150° C. and having a melting point of at most 120° C., a melt viscosity not more than 10,000 cPs at 120° C. and a molecular weight satisfying the inequality:

$$4.0 \leqq \Delta Sp + 1.2 \log M_B \leqq 7.0 \quad (1)$$

wherein log $M_B$ represents logarithm of the molecular weight (or Mw) of (B), and Δ Sp represents the absolute value of the difference of Sp value of (A) and Sp value of (B), are of good thermal shelf stability and electrical properties, high hot offset-causing temperature and improved low temperature fixing properties.

24 Claims, No Drawings

TONER BINDER COMPOSITION AND TONER COMPOSITION

BACKGROUND OF THE INVENTION

1. Field of the Invention

This invention relates to resin compositions suitable for toner. More particularly, it relates to resin compositions suitable as binder for electrophotographic toner.

2. Description of the Prior Art

In electrophotography (xerography), for fixing toner transferred onto paper or the like, there have been widely used fixing means of contact heating [such as those using a heated roller and those via a file or a belt between a heater and paper or the like (for example, JPN Patent Lay open No. 70688/1992 and No. 12558/1992)]. In these methods it is desired that the minimum temperature for fixing (hereinafter referred to as MFT) is low (low temperature fixing properties) and the temperature causing offset to that heated roller (hereinafter referred to as HOT) is high (anti-hot offset properties). Besides, thermal shelf stability is also desired so as not to cause coagulation (or agglomeration) and reduction of flowability under heat evolved from fixers within electrophotographic machines In order to meet these requirements, there have been heretofore proposed to use toner binders having wide range of molecular weight distribution from lower molecular weight to higher molecular weight and having a glass transition temperature (hereinafter referred to as Tg) of 50°–80° C. (for example, JPN Patent Publications No. 20411/1995 and JPN Patent Lay-open No. 21555/1986), and to use polyester resins prepared by using oxyalkylene ether of phenolic resin of novolak type (JPN Patent Lay-open No. 27478/1993).

The above methods, however, cannot sufficiently answer to fixing properties at lower temperature required in recent high speed facsimile or copy machines, or to higher thermal shelf stability desired accompanied with miniaturization of printers.

SUMMARY OF THE INVENTION

It is an object of the present invention to provide a resin composition capable of providing a toner having desired properties of low MFT and high HOT.

It is another object of the present invention to provide a toner binder of improved thermal shelf stability.

It is still another object of the present invention to provide a toner of improved electrical properties, such as frictional charge amount.

It is yet another object of the present invention to provide a toner binder of improved dispersibility and lower viscosity.

Briefly, these and other objects of this invention as hereinafter will become more readily apparent have been attained broadly by a toner binder composition for electrophotography, which comprises a binder resin (A) and an organic material (B) dispersed therein with an average particle size of not more than 5 μm at room temperature said Material (B) being compatible with (A) between 80°–150° C. and having a melting point of at most 120° C., a melt viscosity not more than 10,000 cPs at 120° C. and a molecular weight satisfying the inequality:

$$4.0 \leqq \Delta Sp + 1.2 \log M_B \leqq 7.0 \quad (1)$$

wherein log $M_B$ represents logarithm of the molecular weight ($\overline{Mw}$) of (B), and Δ Sp represents the absolute value of the difference of Sp value of (A) and Sp value of (B).

DETAILED DESCRIPTION OF THE PREFERRED EMBODIMENTS

In the inequality (1), log $M_b$ represents logarithm of the molecular weight ($M_B$) of (B). In case where (B) has a molecular distribution, $M_B$ represents the weight-average molecular weight (hereinafter referred to as $\overline{Mw}$), which can be determined by gel permeation chromatography (GPC).

Δ Sp represents the absolute value of the difference between Sp value of (A) [$Sp_A$] and Sp value of (B) [$Sp_B$], that is, $|Sp_A - Sp_B|$. In the above, Sp (solubility parameter) values $Sp_A$ and $Sp_B$ can be determined, in accordance with Robert F. Fadors, Polymer Engineering Science, Vol. 14, p. 151, by measuring cohesive energy density and molecular volume and calculating a squre root of quotient of cohesive energy density devided by molecular volume:

$$SP = \sqrt{\Delta E / V}$$

wherein Δ E is cohesive energy density and V is molecular volume.

(A) Binder resin

Suitable binder resins (A) used in the present invention can be at least one resin selected from the group consisting of polyester resins (A1), styrenic and/or (meth)acrylic resins (A2) and epoxy resins (A3). These resins (A1), (A2) and (A3) are not particularly restricted, as far as they become compatible with (B) at a temperature between 80°–150° C. and satisfy the inequality (1).

(A1) Polyester resins

Suitable polyester resins (A1) include ones obtainable by polycondensation of a dicarboxylic acid and a dihydric alcohol, with or without a tribasic or more polycarboxylic acid and/or trihydric or more alcohol.

Suitable dicarboxylic acids include, for example, (1) aliphatic dicarboxylic acids containing 2–20 carbon atoms, such as maleic, fumaric, succinic, adipic, sebacic, malonic, azelaic, mesaconic, citraconic and glutaconic acids; (2) cycloaliphatic dicarboxylic acids containing 8–20 carbon atoms, such as cyclohexane dicarboxylic and methylnadic acids; (3) aromatic dicarboxylic acids containing 8–20 carbon atoms, such as phthalic, isophthalic, terephthalic, toluene dicarboxylic and naphthalene dicarboxylic acids; and (4) alkyl- or alkenyl-succinic acids containing 4–35 carbon atoms in the side-chain, such as dodecenylsuccinic and pentadecenylsuccinic acids; as well as anhydrides and lower alkyl (such as methyl and butyl) esters of these acids, such as maleic dodecenylsuccinic and pentadecenylsuccinic anhydrides, and dimethyl terephthalate. Among these, preferred are (1), (3), (4), and anhydrides and lower alkyl esters of these dicarboxylic acids; particularly maleic acid (anhydride), fumaric, isophthalic and terephthalic acids, dimethyl terephthalate and dodecenylsuccinic acid (anhydride). Maleic acid (anhydride) and fumaric acid are preferred with respect to high reactivity. Isophthalic and terephthalic acids are preferred in view of providing higher Tg.

Suitable dihydric alcohols include, for example, (1) alkylene glycols containing 2–12 carbon atoms, such as ethylene glycol, 1,2- and 1,3-propylene glycols, 1,4-butanediol, neopentyl glycol, 1,4-butenediol, 1,5-pentanediol and 1,6-hexanediol; (2) alkylene ether glycols, such as diethylene glycol, triethylene glycol, dipropylene glycol, polyethylene glycols, polypropylene glycols and polytetramethylene glycols; (3) cycloaliphatic diols containing 6–30 carbon atoms, such as 1,4-cyclohexane dimethanol and hydrogenated bisphenol A; and (4) bisphenols, such as bisphenol A, bisphenol F and bisphenol S, as well as (5) adducts of 2–8 moles alkylene oxides [ethylene oxide (hereinafter referred to as EO), propylene oxide (hereinafter referred to as PO) and butylene oxides ] to the above-mentioned bisphenols. Among these, preferred are (1) and particularly (5). Among the above (1), ethylene glance is preferred in view of increasing reaction rate, while 1–2-propylene glycol and neopentyl glycol are preferred with respect to low temperature fixibility. Among the above (5), adducts of 2–4 moles EO and/or PO to bisphenol A are particularly preferred in view of providing good anti-offset properties to toners.

Illustrative of suitable polybasic carboxylic acids having 3 or more carboxyl groups are (1) aliphatic polycarboxylic acids containing 7–20 carbon atoms, such as 1,2,4-butanetricarboxylic acid, 1,2,5-benzenetricarboxylic acid, 1,3-dicarboxyl-2-methyl-2-methylene carboxypropane, tetra-(methylene carboxyl)methane and 1,2,7,8-octanetetracarboxylic acid; (2) cycloaliphatic polycarboxylic acids containing 9–20 carbon atoms, such as 1,2,4-clohexanetricarboxylic acid; and (3) aromatic polycarboxylic acids containing 9–20 carbon atoms, such as 1,2,4-benzenetricarboxylic, 1,2,5-benzenetricarboxylic, 2,5,7-naphthalenetricarboxylic, 1,2,4-naphthalenetricarboxylic, pyromellitic and benzophenonetetracarboxylic acid; as well as anhydrides and lower alkyl (such as methyl and butyl) esters of these. Among these preferred are (3) and anhydrides and lower alkyl esters of them; particularly 1,2,4-benzenetricarboxylic acid, 1,2,5-benzenetricarboxylic acid, and anhydrides and lower alkyl esters of these are preferred, in view of cost and providing anti-offset properties to toners.

Illustrative examples of suitable polyhydric alcohols having 3 or more hydroxyl groups include (1) aliphatic polyhydric alcohols containing 3–20 carbon atoms, such as sorbitol, 1,2,3,6-hexanetetraol, 1,4-sorbitan, pentaerythritol, dipentaerythritol, tripentaerythritol, 1,2,4-butanetriol 1,2,5-pentanetriol, glycerol, 2-methylpropanetriol, 2-methyl-1,2,4-butanetriol, trimethylolpropane and trimethylolethane); (2) aromatic polyhydric alcohols containing 6–20 carbon atoms, such as 1,3,5-trihydroxylmethylbenzene; and alkylene oxide adducts of them; (3) oxyalkylene ethers of phenolic novolak; and (4) oxyalkylene ethers of heterocyclic compounds containing more than two active hydrogen atoms in the molecule, such as isocyanuric acid. Among these, preferred are (1), (3) and (4), particularly (3) and (4).

In the present invention, together with these carboxylic acids and alcohols, there nay be used, if necessary, a monocarboxylic acid and/or a monohydric alcohol, for the purpose of regulating the molecular weight and controling the reaction. Illustrative examples are inclusive of moncarboxylic acids such as benzoic, p-hydroxybenzoic, toluenecarboxylic, salicylic, acetic, propionic and stearic acids; and monohydric alcohols, such as benzyl alcohol, toluene-4-methanol and cyclohexanemethanol.

Ratio of the carboxylic acid component and the alcohol component constituting polyesters of the present invention may be in such a range providing an equivalent ratio of the alcoholic hydroxyl group/the carboxyl group of usually 0.6–1.4, preferably 0.7–1.3, more preferably 0.8–1.2 In case where tribasic or more carboxylic acids and or trihydric or more alcohols are optionally used, the you is usually at most 35%, preferably at most 25%. Use of more than 35% of tribasic or more carboxylic acids and/or trihydric or more alcohols results in toners of higher MFT. In the above and hereinafter, % represents % by weight.

To take an illustration of production method of polyester resin (A1) of the present invention, carboxylic acid and alcohol are mixed in a prescribed ratio, followed by carrying out polyesterification reaction to obtain (A1). The reaction is generally carried out at a temperature of 150°–300° C., preferably 170°–280° C., in the pretense of a catalyst. The reaction may be performed under normal pressure sure, under reduced pressure or under pressure; but it is preferred to carry out the reaction reducing the pressure of the reaction mixture to 200 mmHg or less, preferably 25 mmHg or less after reaching a desired degree of conversion (for instance, 30–90% or so). As the catalyst, there may be mentioned catalysts usually used for polyesterification for example, metals, such as tin, titanium, antimony, manganese, nickel, zinc, lead, iron, magnesium, calcium and germanium; compounds containing these metals, such as dibutyltin oxide, o-dibutyl titanate, tetrabutyl titanate, zinc acetate, lead acetate, cobalt acetate, sodium acetate and antimony trioxide. After the properties [acid number (hereinafter referred to as AV), softening point and so on] of the reaction product reached desired values, or the stirring power or torque of the reactor reached a given value, the reaction is terminated to obtain (A1).

Polyester resins (A1) in the present invention have an AV of usually 0.2–30, preferably 0.3–20 mgKOH/g and hydroxyl number (hereinafter referred to as OHV) of 5–100, preferably 10–70 mg KOH/g. Polyesters having AV less than 0.2 provide toners of lower charging amount; while ones of AV more than 30 result in larger dependence of charging amount on humidity. Ones having OHV less than 5 result in increase of MFT of toners; while ones of OHV more than 100 provide toners of larger dependence of charging amount on humidity.

Number-average molecular weight (hereinafter refereed to as $\overline{Mn}$) of (A1) is usually 1500–15000, preferably 2000–10000, more preferably 2500–8000.

Tg of (A1) is usually 40–85° C., preferably 45°–80° C., more preferably 50°–70° C. Toners formed using polyesters having to less 40° C. as the binder are likely cause adhesion of particles each other and agglomeration (blocking) into on toner particles. On the other hand, polyesters having To over 85° C. provide toners of increased MFT.

Softening point of (A1) is usually 70°–180° C., preferably 80°–160° C. Toners forced using polyesters of softening point less than 70° C. are apt to result in lower HOT; while polyesters of softening point higher than 180° C. provide poor low temperature fixability.

(A2) Styrenic and/or (meth)acrylic resins

Suitable styrenic and/or (meth)acrylic resins (A2) include polymers obtainable by polymerizing (a) styrenic monomer and/or (b) (meth)acrylic monomer, with or without another monomer (c). In the above and hereinafter, (meth)acrylic monomer represents acrylic monomer and/or methacrylic monomer, and similar expressions are used.

Suitable styrenic monomer (a) include, for example, those represented by the formula (2).

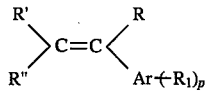

(2)

In the formula (2), R, R' and R' are independently selected from the group consisting of hydrogen and lower alkyl; $R_1$ is selected from the group consisting of hydrogen, C1–C10 alkyl, phenyl, lower alkoxy, hydroxyl and halogen; Ar is an aromatic hydrocarbon group such as phenylene); and p is an integer of 0—3.

Exemplary of said monomers (a) are styrene homologues, including styrene; and substituted styrenes, for instance, alkyl (C1–C8) styrenes (such as α-methylstyrene, o-, m- and p-methylstyrenes, p-ethylstyrene, 2,4-dimethylstyrene, p-n-butylstyrene, p-t-butylstyrene, p-n-hexylstyrene, p-n-octylstyrene, p-n-nonylstyrene and p-n-decylstyrene), arylstyrenes (such as p-phenylstyrene), alkoxy-substituted styrenes (such as p-methoxystyrene), hydroxyl-substituted styrenes (such as p-hydroxystyrene), halogen-substituted styrenes (such as p-chlorostyrene and 3,4-dichlorostyrene) and mixtures of two or more of then (such as mixtures of styrene with one or more substituted styrenes). Among these, preferred are styrene, α-methylstyrene, p-methoxystyrene and p-hydroxystyrene; especially styrene.

Suitable (meth)acrylic monomer (b) include esters of (meth)acrylic acids, for example, alkyl(C1–C18) (meth)-acrylates, such as methyl, ethyl, n- and i- butyl, propyl, n-octyl, 2-ethylhexyl, dodecyl, lauryl and stearyl (meth-acrylates; aryl (meth)acrylates, such as phenyl (meth)-acrylates; hydroxyl-containing (meth)acrylates, such as hydroxyethyl (meth)acrylates; amino-containing (meth)-acrylates, such as dimethylaminoethyl and diethylaminoethyl (meth)acrylates; epoxy-containing (meth)acrylates, such as glycidyl (meth)acrylates; (meth)acrylic acids and derivatives thereof, such as (meth)acrylonitriles and (meth)acrylamides; and the like. Among these, preferred are alkyl (meth)acrylates [such as methyl, ethyl, butyl, 2-ethylhexyl, lauryl and stearyl (meth)acrylates] and (meth)acrylic acids, and mixtures of two or more of them.

Suitable other monomers (c), optionally used in producing resins (A2), include non-crosslinking monomers (monoethylenically unsaturated monomers and conjugated dienes), for example, maleic monomers, such as maleic anhydride, maleic acid, and eaters thereof [mono- and d -alkyl(C1–C18) maleates, such as monobutyl maleate]; vinyl esters, such as vinyl acetate and vinyl propionate; alihpatic hydrocarbon monomers, such as butadiene; vinyl ethers, such as vinylmethyl ether, vinylethyl ether and vinyl-iso-butyl ether; vinyl ketones, such as vinylmethyl ketone, vinyl hexyl ketone and methylisopropenyl ketone: N-vinyl compounds, such as N-vinylpyrrole, N-vinylcarbazole, N-vinylindole and N-vinylpyrrolidine; and the like. Among these, preferred are maleic monomers, vinyl esters and alihpatic hydrocarbon monomers; particularly maleic anhydride and monobutyl maleate.

In producing styrenic/(meth)acrylic resins (A2) in this invention, the contents of said monomers (a), (b) and (c) can be varied widely, but the amount of (c) is usually 0–10%, preferably 0–5%, based on the total monomers. Among these resins (A2), preferred are polystyrene resins [(co)polymers of said monomer(s) (a) and optionally (c) such as polystyrene and copoylmers of styrene with maleic anhydride and/or monobutyl maleate], and styrene/(meth)-acrylic copolymers [copolymers of said monomers (a) and (b) and optionally (c)]. More preferred are styrene/(meth)-acrylic copolymers, particularly such copolymers containing at least 50% (especially at least 60%) of said monomer (a) and at least 2% (particularly at least 5%) of said monomer (b).

Said resin (A2) can be produced by polymerizing said monomer (a) and/or (b) with or without (c), in the presence of one or more polymerization initiators, using any known polymerization techniques, such as solution polymerization, bulk polymerization, suspension polymerization and emulsion polymerization, and combinations of them (for instance, solution polymerization followed by suspension or bulk polymerization, or suspension polymerization followed by solution or bulk polymerization). In order to attain polymers of broader molecular weight distribution relatively lower molecular weight part and higer molecular weight part may be polymerized separately, or polymerization of one of these parts may be carried out in the presence of the rest of them.

In general, (A2) has $\overline{Mn}$ of 2,000–15,000 and $\overline{Mw}$ of 100,000–1,000,000, which can be measured by GPC using tetrahydrofuran (hereinafter referred to as THF) with use of calibration curve of standard polystyrenes. Polymers having $\overline{Mn}$ less than 2,000 result in poor thermal shelf stability, while $\overline{Mn}$ higher than 15,000 causes increase of MFT. Polymers of $\overline{Mw}$ less than 100,000 causes reduction of HOT, while ones of $\overline{Mw}$ higher than 1,000,000 result in higher MFT. Molecular weight distribution ($\overline{Mw}/\overline{Mn}$) of (A2) is usually at least 3.5, preferably 20–40 or more.

Tg of (A2) [particularly styrene/(meth)acrylic copolymers] is generally 40°–85° C., preferably 45°–80° C. Tg lower than 40° C. results in poor heat shelf stability. Tg over 85° C. causes increase of MFT.

In ease of copolymers containg units of carboxylic acid monomer [such as (meth)acrylic acid and maleic acid], such polymers preferably have an AV of not more than 30, especially 0.3–20, in view of temperature dependence of charge amount.

(A3) Epoxy resins

Suitable epoxy resins include conventionally employed ones, as described in "EPOXY RESINS" published 1957 by McGraw-Hill, for example, glycidyl ethers, including those of phenol type, bisphenol type and polyphenolic type [adduce of epichlorhydrin with phenolic compounds, including aromatic di- or polyols, such as bisphenols (bisphenol A, bisphenol F and the like), novolaks (phenol novolak, cresol novolak and the like), resorcinol and so on], phenol epoxy resins, aromatic epoxy resins, cycloaliphatic epoxy resins, ether type epoxy resins (adducts of epichlorhydrin with polyols, polyether polyols and the like), such as polyol di- and tri-glycidyl ethers, and so on; and modified products of these epoxy resins, for example, reaction products of these epoxy resins (such as adducts of epichlorhydrin with bisphenol A) with a monocarboxylic acid (such as benzoic, p-hydroxybenzoic, toluenecarboxylic, salicylic, acetic, propionic and stearic acids). Preferred are adducts of epichlorhydrin with bisphenol A. Epoxy resins usually have an epoxy equivalent of generally 140–4000, preferably 190–2,500. Illustrative of suitable epoxy resins include commercially available Epikote 1004 (produced by Shell), Araldite 6064 and 7072 (produced by Ciba-Geigy) and AER 664 (produced by Asahi Kasei).

In addition to (A1)–(A3), there nay be used one or more other resins, such as polyamide resins (A4) and polyurethane resins(A5).

(A4) Polyamide resins

Suitable polyamide resins include ones obtainable from a polycarboxylic acid and a polyamide, with or without a monocarboxylic acid and/or monoamine. Illustrative of suitable polycarboxylic acids are polymerized fatty acids for example, diner acids obtained by polymerization of unsaturated fatty acids, such as linoleic and oleic acids; and dicarboxylic acids and polybasic carboxylic acids having 3 or more carboxyl groups, as mentioned above as the raw materials for (A1). Among these, preferred are polymerized fatty acids and combinations thereof with dicarboxylic acids mentioned above. Examples of suitable polyamines include (1) aliphatic polyamines, for example alkylenediamines containing 2–6 or more carbon atoms, such as ethylenediamine, 1,2- and 1,3-diaminopropanes and hexamethylenediamines, and polyalkylene polyamines, such as diethylenetriamine and triethylene tetramine; (2) cycloaliphatic polyamines, such as isophonediamine and cyclohexylenediamines; and (3) aromatic polyamines, such as xylylenediamine and diaminodiphenylmethane. Among these, preferred are (1), particularly ethylenediamine, 1,3-diaminopropane and hexamethylenediamines and combinations thereof with diethylenetriamine. Exemplery of suitable monocarboxylic acids are (1) straight-chain or branched saturated or unsaturated fatty acids containing 1–22 carbon atoms such as acetic, propionic and stearic acids and mixed fatty acids (such as fatty acids of pain oil tall oil, soybean oil, rice oil, tallow, fish oil and the like); and (2) aromatic monocarboxylic acids, such as benzoic, p-hydroxybenzoic, toluenecarboxylic, salicylic and 4,4-bis(hydroxyaryl)butyric acids. Among there, preferred are (1). Illustrative of suitable monoamines are n-propyl-amine, stearylamine, oleylamine and monoethanolamine. In producing polyamide resins, carboxylic acids and amines are used in an amount providing an equivalent ratio of carboxyl group to amino group of generally 0.6–1.4, preferably 0.7–1.3, particularly 0.8–1.2. Polyamide resins have $\overline{Mn}$ of usually 500 20,000, preferably 1,000–15,000, and the sum of AV and amine value of usually at most 50, preferably at most 30, particularly at most 20 mgKOH/g. In case polyamide resin (A4) is used in combination with any of (A1)–(A3) (A4) may be thermoplastic ones incompatible with (A1)–(A3) at a temperature lower than 100° C. and compatible therewith at a temperature of 100°–150° C., or ones incompatible with (A1)–(A3) even at a temperature up to 200° C.

(A5) Polyurethane resins

Suitable polyurethanes are inclusive of reaction products of a polyisocyanate component with a polyol component. Suitable polyisocyanates include, for example aromatic ones containing 6–20 carbon atoms (except carbon atoms in NCO groups), such as 2,4- and 2,6-tolylene diisocyanates (hereinafter referred to as TDI), 4,4'- and 2,4—diphenylmethane diisocyanates (hereinafter referred to as MDI) and dimethyl MDI; cycloaliphatic ones containing 4–15 carbon atoms, such as isophorone diisocyanate (hereinafter referred to as IPDI) and dicyclohexylmethane diisocyanate; aliphatic ones containing 2–18 carbon atoms, such as ethylene diisocyanate, tetramethylene diisocyanate, hexamethylene diisocyanate (hereinafter referred to as HDI) and lysine diisocyanate; araliphatic ones containing 8–15 carbon atoms, such as xylylene diisocyanate; and modified polyisocyanates of these (such as modified ones containing urethane, carbodiimide, allophanate, urea, biuret urethdione, urethonimine, isocyanurate or/and oxazolidone groups), for example, water-modified products, dimers or trimers of HDI, TDI, MDI or IPDI [such as "Sumidur N" (produced by Sumitomo-Bayer Urethane Co.) and "Corrugate AP" (Produced by Nippon Polyurethane Co.)]; as well as mixtures of two or more of them. Among these, preferred are diisocyanates. Particularly, TDI, MDI, dimethyl MDI and IPDI. Suitable polyols include low molecular weight polyols of $\overline{Mn}$ less than 500, and polymeric polyols, such as polyether polyols and polyester polyols, having $\overline{Mn}$ of 500–3,000 or more. Illustrative of low molecular weight polyols and polyether polyols are the same ones as mentioned above in (A1) (cyclo)aliphatic and aromatic polyols (including diols, trials and polyhydric alcohols having 3 or more hydroxyl groups), alkylene oxide adducts thereof and polyalkyleneglycols). Suitable polyester polyols include ones obtainable by polycondensation of a dicarboxylic acid component with a diol component as above, and ones obtained by ring-opening polymerization of a lactone (such as ε-caprolactone). Among these diols, preferred are alkylene oxide adducts of aromatic diols, aliphatic diols and combinations of them, particularly alkylene oxide (PO and/or EO) adducts of aromatic diols (especially bisphenol A). In producing polyurethanes, polyisocyanates and polyols are used in an amount providing an equivalent ratio of isocyanate group to hydroxyl group of generally 0.6–1,4, preferably 0.7–1.3, particularly 0.8–1.2. In case polyurethane resin (A5) is used in combination with any of (A1)-(A3), (A5) may be thermoplastic ones having $\overline{Mn}$ of usually 500–20,000 (preferably 1,000–15,000) incompatible with (A1)-(A3) at a temperature lower than 100° C. and compatible therewith at a temperature of 100°–150° C.; or thermoplastic ones having $\overline{Mn}$ of usually 5,000–400,000 (preferably 10,000–300,000) and a storage elastic modulas of at least $1\times10^6$ dyn/cm$^2$ at 180° C. and being incompatible with (A1)–(A3) at 120° C. or less and compatible therewith at a temperature of 150°–220° C.

Among these binder resins, preferred are those mainly comprised of at least one of (A1)–(A3), which nay contain a minor amount [for instance 3–45 parts, preferably 5–30 parts by weight, per 100 parts by weight of (A1)–(A3)] of other resins [such as (A4) and (A5)].

Among (A1)–(A3), preferred (A1) and (A2) [especially styrene/(meth)acrylic copolymers]. Most preferred is (A1).

(B) Dispersed Organic Material

Organic materials (B), dispersed within said binder resin (A) at room temperature, include ones satisfying the inequality (1), which way be selected among waxes (B1) and oligomers (B2).

Examples of suitable waxes (B1) are as follows. (B1–1) hydrocarbon waxes (C18–70 or more), which may be halogenated, such as paraffin wax, microcrystalline wax, polyethylene wax, polypropylene waxes, chlorinated polyethylene wax and fluorocarbon wax. (B1–2) higher fatty acid waxes (C10–32 or more), for example, stearic acid, pain oil fatty acid and hydroxyfatty acids (such as ricinstearoic acid). (B1–3) higher fatty amide waxes (C10–70 or more), for example, fatty acid monoamides (such as stearamide and N-stearyl-erucamide), and fatty acid bisamides (such as N,N'-ethylenebisoleylamide).

(B1–4) higher fatty ester waxes (C10–70 or more), for example, i) natural ester waxes, including animal or vegetable waxes (such as candelilla wax, carnauba wax, sazole wax, rice wax, bees wax, Japan wax and the like) mineral waxes (such as montan wax); and ii) fatty acid partial or complete esters of polyhydric alcohols [for instance, glycerol, glycols (such as ethylene glycol), trimethylolpropane, pentaerythritol, sorbitol, sorbitan, polyalkylene glycols (such as polyethylene glycol) and polyglycerol], such as tristearin, ethylene glycol dioleate, sorbitan tristearate, pentaerythritol tri- or tetra-stearate, trimethylolpropane di- or tri-behenate polyalkylene glycols and polyglycerol partial fatty esters (such as "Panasate R218", produced by Nippon Fat & Oil Co.).

(B1–5) alcohol waxes, for example, higher fatty alcohols (C12–30 or more; such as stearyl alcohols and behenyl alcohols), and polyhydric alcohols (C3–30 or more; such as trimethylolpropane, mannitol and sorbitol). (B1–6) urethane waxes, for example, waxy compounds obtainable by urethane-forming reaction of mono- or/and polyisocyanates with monohydric or/and polyhydric alcohols. [Suitable monoisocyanates include aryl isocyanates, such as phenyl isocyanate and alkyl(C1–20) isocyanates; and polyisocyanate include those mentioned above in (A5), for example IPDI, HDI, TDI, MDI and modified products of them (e.g. "Sumidur N" and "Corronate AP"). Suitable monohydric alcohols include higher fatty alcohols as mentioned above in (B1–5); and polyhydric alcohols include those mentioned above in (A5, such as (cyclo)aliphatic and aromatic polyols, polyalkylene glycols and polyester diols.] (B1–7) oxidized waxes, for example, oxidized products of these waxes (such as polyethylene wax, polypropylene wax and montan wax).

(B1–8) vinyl-modified waxes, for example, these waxes grafted with a vinyl monomer [such as (meth)acrylonitriles, (meth)acrylic acids, hydroxyalkyl (C2–6 or more) (meth)-acrylates, alkyl (C1–18 or more) (meth)acrylates, and mixtures of these] or modified by maleic acid (anhydride so as to regulate Sp value of (B) to satisfy the inequality (1). [The amount and kind of modifier to be used for modification are selected in accordance with the kind of the wax to be modified and the kind of the resin (A) used in combination therewith.]

Examples of suitable oligomers (B2) are as follows (B2–1) olefinic or vinylic oligomers, including oligomers of mono-olefins [for example, ethylene, propylene, butene-1, iso-butylene, α-olefins (C5–20 or more; such as octene-1, decene-1)]; diene oligomers [for instance, oligomers of dienes (C4–20 or more; such as butadiene, chloroplene, isoprene, 1,3-pentadiene, cyclopentadiene), and cyclic oligomers (such as dicyclopentadiene)]; and oligomers of styrenic or/and (meth)acrylic monomers mentioned above (A2) [for example, styrene oligomer and styrene/alkyl(C1–18) (meth)acrylate oligomers].

(B2–2) ring-opening polymerization oligomers, for example. oligomers of cyclic ethers [alkylene oxides (C2–4 or more, such as EO, PO and THF)], such as polyethylene glycol, polyoxyethylene-polyoxypropylene glycol and polytetrametylene ether glycol.

(B2–3) polycondensation or polyaddition oligomers, for example, polyester oligomers [such as unsaturated polyesters, obtainable by polycondensation of polyhydric alcohol (e.g. ethylene glycol) with unsaturated polyearboxylic acid (e.g. Baltic anhydride) and saturated polycarboxylic acid (e.g. phthatic acid)]; polyamide oligomers [such as polycondensates of polymerized fatty acid (e.g. dimer acid) with polyamide as mentioned above in (A4) (e.g. ethylene diamine)]; polyurethane oligomers [such as reaction products of polyisocyanates as mentioned above (A5) (such as TDI) with polyols as mentioned above (A5) (such as 1,4-butane diol)].

(B2–4) addition condensation oligomers, for example, phenolic resins (novolak and resol resins), amino resins (urea and melamine resins), xylene resins and ketone resins (ones obtainable from methyl ethyl ketone, cycloheanone, methylcycloheanone and acetophenone).

(B2–5) petroleum resins, for example, aliphatic petroleum resins, such as C5 petroleum resin and C9 petroleum resin obtainable by polymerizing C4–C5 or C9 fraction among cracked petroleum fractions formed by thermal cracking of naphtha, with or without diene and/or olefin, and cycloaliphatic petroleum resins, such as dicyclopentadiene petroleum reside; and partly or fully hydrogenated products of them. These petroleum resins has $\overline{Mn}$ of usually 200–5,000 (preferably 300–3,000, more preferably 400–2,500), and softening point of 60°–170° C. (preferably 65°–160° C., more preferably 70°–350° C.).

(B2–6) fluorin- or silicon-containing oligomers, for example, fluoro-olefin telomers and perfluoro-olefin oligomers (obtainable from fluorin-containing monomers, such as tetrafluoroehtylene, chlorotrifluoro-ethylene and hexafluoropropylene), and perfluoropolyethers (such as oligomers of hexafluoropropylene epoxide); and silicone oligomers.

These materials (B) may be used alone or as a mixture of 2 or more of them.

Among there materials (B), preferred are waxes (B1). More preferred are higher fatty amide waxes (B1–3), higher fatty ester waxes (B1–4) [particularly ii) fatty acid esters of polyhydric alcohols], and urethane waxes (B1–6).

Said organic material (B), in this invention, is dispersed within said binder resin (A) at room temperature and maintain the dispersed phase at temperature less than 80° C.; but at least a part of (B) becomes compatible with (A) dissolved thereinto at a temperature (hereinafter referred to as compatibilizing temperature) of at least 80° C. and not more than 150° C. The compatibilizing temperature [whether (B) is compatibilized within (A)] can be measured by observing the dispersed phase with a light micro-scope (such as Nikon OPTIPHOT-POL) at a magnification of 400×, equipped with a heating and cooling device for a microscope (such as Japan Hitech TH 600RH), increasing the temperature to 80°–150° C. at a ratio of 5°–30° C. per minute. Improved thermal shelf stability and low temperature fixing properties are attained, according to the invention, by the selection of (B) providing a compatibilizing temperature of 80°–150° C. (preferably 90°–140° C.). Materials having a compatibilizing temperature less than 80° C. result in poor thermal shelf stability. On the other hand, improved low temperature fixing properties are not attained by waxes used in known toners as releasing agents for the purpose of improving anti-offset properties, which agents must be incompatible with the binder resins between 80°–150° C. since no releasing effects are obtained in case of being compatibilized.

Melting point (hereinafter referred to as mp) of said material (B) is at most 120° C. and higher than the room temperature or storage temperature, preferably 45°–120° C., more preferably 50°–110° C., when the up exceeds 120° C., low temperature fixability becomes insufficient. Materials liquid at the room temperature or storage temperature result in poor shelf stability.

Melt viscosity of said material (B) is at most 10,000 cPs, preferably at most 5,000 cPs, more preferably at most 3,000 cPs at 120° C., in view of low temperature fixability.

Molecular weight ($M_B$) of said material (B) is not particularly restricted, as far as providing mp and melt viscosity within the above range and satisfying the inequality (1), but is usually at most 10,000, preferably at most 5,000, more preferably at most 3,000. The value Of $\Delta$ Sp + 1.2 log $M_B$ is in the range of 4.0–7.0, preferably 4.2–6.8, more preferably 4.5–6.5. When the value is lower than 4.0, shelf stability of toners becomes poor; while MFT is increased if the value exceeds 7.0.

Examples of suitable combinations of (B) with (A) include the following combinations, among which are selected ones giving the value of $\Delta$SP+1.2 log $M_B$ in the range of 4.0–7.0 and providing a compatibilizing temperature (hereinafter referred to as Tcmp) in the range of 80°–150° C.

| Resin (A) | | | Wax Material (B1) | | | |
|---|---|---|---|---|---|---|
| Kind | Tg, °C. | Sp | Kind | $M_B$ | mp, °C. | Sp |
| 1) Poly- | 50 | 8 | 3) fatty amide | 300–1500 | 50–110 | 6–10 |
| ester | — | — | 4ii) natural ester wax | 300–1500 | 50–110 | 6–10 |
| resin | 70 | 11 | 6) urethane wax | 500–2000 | 50–110 | 6–10 |
| 2) Styrenic | 45 | 8 | 3) fatty amide | 300–1500 | 50–110 | 6–10 |
| /(meth)- | — | — | 4ii) natural ester wax | 300–1500 | 50–110 | 6–10 |
| acrylic | 80 | 11 | 6) urethane wax | 500–2000 | 50–110 | 6–10 |
| resin | | | | | | |
| 3) Epoxy | 50 | 8 | 3) fatty amide | 300–1500 | 50–110 | 6–10 |
| resin | — | — | 4ii) natural ester wax | 300–1500 | 50–110 | 6–10 |
| | 70 | 11 | 6) urethane wax | 500–2000 | 50–110 | 6–10 |

(III) Binder composition

In the toner binder composition of this invention, the content of (B) is usually 0.05–40%, preferably 0.1–30%, based on the weight of (A). The content lower than 0.5 results in poor low temperature fixability, and the content higher than 40 provides lower HOT.

Methods for dispersing, within (A), (B) with an average particle size not more than 5 μm, are not particularly restricted, and include those by kneading them at state melted under heat, those by blending them in the presense of a solvent followed by evaporating the solvent.

When dispersed particle size exceeds 5 μm, dispersibility of colorant such as carbon black and charge controller within toner is likely to become insufficient.

Particle size of (B) can be measured by photograph rapture cross-section of toner binder with a light microscope (such as Nikon OPTIPHOT-POL) or a scanning electron microscope such as Hitachi S-800) at a magnification of 400 × or so, followed by calculation by printed image analysis of the above micrograph with a printed image analyzer.

Toner binder compositions may further contain one or more conpatibilizers, for example, block, graft or modified polymers having a moiety same as the resin (A) and a moiety having affinity to the material (B), such as those obtainable by polymerizing styrenic and/or (meth)acrylic monomer in the presence of the material (B), and reaction products of unsaturated compound containing reactive group (such as isocyanate group, acid anhydride group and so on) [for examples (meth)acryloyl isocyanates and maleic anhydride] with polyester. The amount of comparibilizer is usually 0.05–20% based on the weight of the composition. In case of using a compatibizer, the temperature of (B) becoming compatible with (A) in the presence of the compatibizer is to be in the range of 80°–150° C.

Illustrative examples of electrophotographic toner preparation, in which the binder of this invention is used include, for example, ones comprises generally 45–95% of the toner binder, usually 5–10% of known colorants (such as carbon black, iron black, benzidine yellow, quinacridone, rhodamine B, phthalocyanine and the like), and generally 0–50% of magnetic powders (such as iron, cobalt nickel, hematite, ferrite and the like).

In addition, there may be contained various additives [for example, charge controllers (such as metal complexes and nigrosine), lubricants (such as polytetrafluoroethylene, low molecular weight polyolefins, fatty acids, or metal salts or asides thereof), and so on]. The amount of these additives are usually 0–10% based on the weight of toner. Electro-photo-graphic toner can be prepared by dry blending these components and then melting under kneading, followed by crushing, and then finely pulverizing with a grinder such as jet grinder into fine particles of 5–20 μm diameter. In producing toners, (A) and (B) may be blended beforehand, or added separately.

Said electrophotographic toner can be optionally mixed with carrier particles, such as iron powder, glass beads nickel powder, ferrite and the like, and used as developer for electrical latent images. Besides, hydrophobic colloidal silica powder may be used to improve flowability of powders.

Said electrophotographic toner can be used by fixing on substrates (such as paper, polyester file and the like). Fixation means are as mentioned above.

Having generally described the invention, a more complete understanding can be obtained by reference to certain specific examples, which are included for purposed of illustration only and not intended to be limiting unless otherwise specified.

In the following examples, parts and ratio mean parts by weight and weight ratio, respectively.

Measuring methods and conditions are as follows:

Measuring methods of properties of binder compositions, prepared in Preparation Examples, Examples and Comparative Examples, are as follows:

1. AV: Method in accordance with JIS K0070, wherein, in case the sample is not dissolved, solvent such as dioxane or THF is used.
2. Tg: Method in accordance with ASTM D3418-82(DSC Method).
3. Softening point with the use of a Flow tester CFT-500, produced by Shimadzu, using a nozzle of 1.0 mm ø×1.0 mm, at a load of 10 Kg, at a heating rate of 5° C. /minute, the temperature at which a half amount of 1.5 g sample has flowed out is measured.

EXAMPLE 1–3, AND COMPARATIVE EXAMPLES 1 AND 2

(1) Into a reaction vessel equipped with a thermometer a stirrer with a torque sensor, a condenser and a nitrogen inlet tube, were charged 320 parts of a PO adduct of bisphenol A (OHV 320), 262 parts of terephthalic acid, 89 parts of dodecenylsuccinic anhydride, 150 parts of 4 moles PO adduct of a phenolic resin of novolak type (number of nucleate of about 5) and 2.5 parts of dibutyltin oxide, followed by reacting them at 230° C. under an atmosphere of nitrogen. After the reaction mixture presented clear apparence, the temperature was reduced to 190° C., and polyesterification reaction was proceded under reduced pressure. Viscosity of the reaction mixture became gradually increased, followed by terminating the reaction when the torque of the stirrer reached a given value, to obtain a polyester resin (A-i) of the present invention having Sp value of 9.8. AV of 1.5, Tg of 59° C. and a softening point of 131° C.

(2) Then, to 100 parts of (A-i), were added 15 parts of each material shown in Table 1, followed by mixing them under stirring for an hour to obtain toner binder compositions.

(3) With 87 parts of each toner binder composition, were homogeneously mixed 7 parts of carbon black (MA100), a polypropylene wax ("Viscol 550P" produced by Sanyo Chemical Industries) and 2 parts of a charge controller (Spironblack TRH), and thereafter kneaded with a twin-screw extruder of bulk temperature 150° C., followed by finely pulverizing the cooled kneaded mixture with a jet mill and then classifying with a dispersion separator to obtain toner particles having average diameter of 12 μm.

TABLE 1

| | Material | Sp value | $\overline{Mw}$ | mp °C. | Melt vis. (120° C.) |
|---|---|---|---|---|---|
| (B-i) | Pentaerythritol tetrastearate | 7.5 | 1200 | 60 | 20 cPs |
| (B-ii) | N,N'-ethylenebis-oleylamide | 8.4 | 600 | 100 | 35 cPs |
| (B-iii) | Urethane wax (HAD8050*) | 8.8 | 750 | 75 | 60 cPs |
| (b-i) | Paraffin wax | 6.1 | 600 | 50 | 10 cPs |
| (b-ii) | Oxidized poly-ethylene wax | 6.6 | 2000 | 110 | 1500 cPs |

(Note) *produced by Nippon Fine Wax Co.)

(4) Dispersibility and particle size of dispersed phase at 50° C. and states [whether it was dissolved into the resin (A-i)] at 100° C. of the resulting toners were observed with a light Microscope (Nikon OPTIPHOT-POL) equipped with a heating and cooling device for a Microscope (Japan Hitech TH 600RH). The results were as shown in Table 2.

TABLE 2

| | | Dispersed phase at 50° C. | | States | |
|---|---|---|---|---|---|
| | Material | Dispersibility | Particle size, μm | at 100° C.* | Δ Sp + 1.2 $\log M_B$ |
| Example | 1 (B-i) | dispersed | 1.0 | ⊙ | 6.0 |
| | 2 (B-ii) | dispersed | 2.5 | ○ | 4.7 |
| | 3 (B-iii) | dispersed | 1.5 | ⊙ | 4.4 |
| Comparative Example | 1 (b-i) | dispersed | >10 | X | 7.1 |
| | 2 (b-ii) | not dispersed | — | X | 7.2 |

(Note)
*⊙: fully dissolved into the resin; o: partly dissolved into the resin; and X: not dissolved into the resin.

(5) These toner compositions were evaluated in the following Test I-Test IV. The results were as shown in Table 3.

TEST I—EVALUATION OF MFT

To 3 parts of each toner composition, were added and homogeneously mixed 97 parts of ferrite carrier (F-100 produced by Powderteck Co.) to prepare developer, and toner image formed therewith was transferred onto paper with a commercially available copy machine (BD-7720 produced by Toshiba Corp.), followed by fixing the transferred toner on the paper with use of another commercially available copy machine (SF8400A produced by Sharp Corp.), whose fixing parts had been modified so as to provide a speed of 35 A4 sheets/minute, to evaluate MFT [the temperature of the heated roller providing printed image density of solid part remained at least 70% after 5 times reciprocating rubbing of black solid part of printed image density 1.2 with a Gakushin fastness tester (rabbed part=paper)].

TEST II—EVALUATION OF HOT

To 3 pasta of each toner composition, were added and homogeneously mixed 97 parts of ferrite carrier (F-100) to prepare developer, and toner image formed therewith was transferred onto paper with the copy machine (BD-7720). followed by fixing the transferred toner on the paper with use of the other copy machine (SF8400A), whose fixing parts had been modified to a speed of 10 A4 sheets/minute, to evaluate HOT (the temperature of the heated roller at the time when the toner was hot offset).

TEST III—EVALUATION OF THERMAL SHELF STABILITY

Into a screw tube of 20 c.c., were charged 10 g of each toner composition and allowed to stand at 50° C.×40% R. H. for 24 hours, and thermal shelf stability was evaluated with 4 grades according to the degree of blocking of toner.

⊙: No aglomerate was observed.

○: Aglomerate was slightly observed, which was redispersible with a slight shock to the screw tube.

Δ: Aglomerate of ¼ or so of toner was observed, which was not redispersible with a slight shock to the screw tube.

X: Severe aglomelate was observed, which was not redispersible even with a strong shock to the screw tube.

TEST IV—MEASUREMENT OF FRICTION CHARGE AMOUNT

Into a 50 c.c. glass bottle, 3 parts of each toner composition and 97 parts of ferrite carrier (F-100) were charged, and allowed to stand for 12 hours within a temperature and humidity controlled room of 25° C. and 50% R. H, followed by friction charging by stirring for 30 minutes at 100 r.p.m. with a tubular shaker mixer under conditions or 25° C. and 50% R. H. Thereafter, the charged amount was measured with a blow-off charge amount measuring device produced by Toshiba, Corp.

TABLE 3

| | | Material | MFT (°C.) | HOT (°C.) | Thermal shelf stability | Friction charge amount (μc/g) |
|---|---|---|---|---|---|---|
| Example | 1 | (B-i) | 135 | >200 | ⊙ | −25 |
| | 2 | (B-ii) | 130 | >200 | ⊙ | −23 |
| | 3 | (B-iii) | 140 | >200 | ⊙ | −26 |
| Comparative Example | 1 | (b-i) | 155 | >200 | ⊙ | −22 |
| | 2 | (b-ii) | 160 | >200 | ⊙ | −21 |

EXAMPLE 4–6, AND COMPARATIVE EXAMPLES 3 AND 4

(1) In the same manner as in Example 1 (1), 308 parts of a PO adduct of bisphenol A (OHV 320), 379 parts of an EO adduct of bisphenol A (OHV 340), 312 parts of terephthalic acid and 2.5 parts of dibutyltin oxide were reacted to obtain a polyester resin (A-ii) of the present invention having Sp value of 9.9. AV of 10, Tg of 59° C. and a softening point of 110° C.

(2) Then, to 100 parts of (A-ii), were added 10 parts of each material shown in Table 1, followed by mixing them under stirring for an hour to obtain toner binder composition.

(3) with 95 parts of each toner binder composition, were homogeneously mixed 5 parts a of a chromatic pigment (Fastgen magenta R-11, produced Dainippon Ink Co.), and thereafter kneaded with a twin-screw extrudes of bulk temperature 150° C., followed by finely pulverizing the cooled kneaded mixture with a jet mill and then classifying with a dispersion separator to obtain toner particles having average diameter of 9 μm.

(4) Dispersibility and particle size of dispersed phase at 50° C. and states at 100° C. of the resulting toners were observed in the sane manner as in Examples 1–3 (4). The results were as shown in Table 4.

TABLE 4

| | | Dispersed phase at 50° C. | | States | |
|---|---|---|---|---|---|
| | Material | Dispersibility | Particle size, μm | at 100° C.* | Δ Sp + 1.2 $\log M_B$ |
| Example | 4 (B-i) | dispersed | 0.5 | ⊙ | 6.1 |
| | 5 (B-ii) | dispersed | 2.0 | ○ | 4.8 |
| | 6 (B-iii) | dispersed | 1.0 | ⊙ | 4.5 |
| Comparative Example | 3 (b-i) | dispersed | >10 | X | 7.2 |
| | 4 (b-ii) | not dispersed | — | X | 7.3 |

(Note) *same as in Table 2.

(5) These toner compositions were evaluated in accordance with Test I–Test IV, except that a fixing device equipped with a silicone oil feeder and a heated roller was substituted for the fixing part in Teat I and Test II. The reality where as shown in Table 5.

TABLE 5

| | Material | MFT (°C.) | HOT (°C.) | Thermal shelf stability | Friction charge amount (μc/g) |
|---|---|---|---|---|---|
| Example | 4 (B-i) | 115 | >200 | ⊙ | −20 |
| | 5 (B-ii) | 110 | >200 | ⊙ | −21 |
| | 6 (B-iii) | 120 | >200 | ⊙ | −19 |
| Comparative Example | 3 (b-i) | 135 | >200 | ⊙ | −18 |
| | 4 (b-ii) | 140 | >200 | ⊙ | −22 |

EXAMPLE 7 AND COMPARATIVE EXAMPLE 5

(1) Into a vessel equipped with a thermometer, a stirrer, a condenser and a nitrogen inlet tube, were charged 40 parts of a styrene/n-butyl acrylate (80/20) copolymer having $\overline{Mn}$ of 280,000, $\overline{Mw}$ of 760,000 and Tg of 62° C. prepared by suspension polymerization, and 60 parts of a polystyrene having $\overline{Mn}$ of 2,500, $\overline{Mw}$ of 5,900 and Tg of 58° C. prepared by solution polymerization. Then, 120 parts of xylene were added under an atmosphere of nitrogen and heated under stirring to a reflux temperature, followed by continuing stirring under reflex for 3 hours. Thereafter, volatile matters were removed by heating up to 180° C. at normal pressure and then under reduced pressure at the temperature, followed by continuing heating for 1.5 hours at 20 mmHg, to obtain a styrene/acrylic copolymer (A-iii) of the present invention having Sp value of 9.1.

(2) Example 1 (2)–(5) and Comparative Example 1 (2)–(5) were repeated, except that 10 parts of the material (B-i) or (b-i) were added to 100 parts of (A-iii) instead of (A-i), to obtain toner particles having average diameter of 10 μm. The results were as shown in Table 6.

TABLE 6

| Material | | Example 7 (B-i) | Comparative Example 5 (b-i) |
|---|---|---|---|
| Dispersed phase at 50° C. | Dispersibility | dispersed | dispersed |
| | Particle size, μm | 1.0 | >10 |
| States at 100° C.* | | ○ | X |
| Δ Sp + 1.2 $\log M_B$ | | 5.3 | 7.1 |
| MFT (°C.) | | 145 | 170 |
| HOT (°C.) | | >200 | >200 |
| Thermal shelf stability | | ⊙ | ⊙ |
| Friction charge amount (μ c/g) | | −27 | −20 |

(Note) *same as in Table 2.

Toner binder appositions and toner compositions of the present invention exhibit excellent low temperature fixability, upon heating to 80°–150° C. at fixing, said material (B) becoming compatible with the binder resin (A) to reduce melt viscosity; and also show good thermal shelf stability and anti-hot offset properties, (B) being dispersed, within (A), at room temperature, with an average particle size of not more than 5 μm. Besides, they provide good charging properties and durability.

Toner compositions attained using toner binder compositions of this invention are useful in application in copying machines of various speed (particularly high speed ones), printers and full-color ones, since they satisfy both the practical performance requirements, such as thermal shelf stability, charging properties and durability, in addition to fixing properties (low temperature fixability and anti-hot offset properties).

What is claimed as new and desired to be secured by Letters Patent is:

1. A toner binder composition for electrophotography, which comprises a binder resin (A) and an organic material, (B) dispersed therein with an average particle size of not more than 5 μm at room temperature; said material (B) becoming compatible with (A) at a temperature between 80°–150° C. and having a melting point of at most 120° C., a melt viscosity of at most 10,000 cps. at 120° C. and a molecular weight satisfying the inequality:

$$4.0 \leqq \Delta Sp + 1.2 \log M_B \leqq 7.0 \quad (1)$$

wherein $\log M_B$ represents logarithm of the molecular weight or the weight-average molecular weight of (B), and Δ Sp represents the absolute value of the difference of Sp value of (A) and Sp value of (B).

2. The composition of claim 1, wherein (A) is at least one resin selected from the group consisting of polyester resin (A1); styrenic, acrylic or methacrylic resin (A2) and epoxy resin (A3).

3. The composition of claim 1, wherein (A) is a polyester resin.

4. The composition of claim 1, wherein (A) is a polystyrene resin, or a styrene/acrylic or methacrylic copolymer.

5. The composition of claim 1, wherein (A) has a Tg of 45°–80° C.

6. The composition of claim 1, wherein (B) is at least one selected from the group consisting of a wax (B1), an oligomer (B2) and a petroleum resin (B3).

7. The composition of claim 6, wherein (B1) is selected from the group consisting of hydrocarbon wax, fatty acid wax, fatty amide wax, fatty ester wax, fatty alcohol wax, urethane wax, oxidized wax and vinyl-modified wax.

8. The composition of claim 6, wherein (B2) is selected from the group consisting of vinylic oligomer, polyalkylene glycol, polyester oligomer, polyamide oligomer polyurethane oligomer, phenolic resin oligomer amino resin oligomer, xylene resin oligomer, ketone resin oligomer, silicone oligomer and fluoro-containing oligomer.

9. The composition of claim 1, wherein the weight ratio of (A) to (B) is 100/0.11–100/30.

10. A toner composition for electrophotography, which comprises a binder resin (A), an organic material (B) dispersed therein with an average particle size of not more than 5 μm at room temperature, and a colorant; said material (B) becoming compatible with (A) at a temperature between 80°–150° C. and having a melting point of at most 120° C. a melt viscosity of at most 10,000 cps. at 120° C. and a molecular weight satisfying the inequality:

$$4.0 \leqq \Delta Sp + 1.2 \log M_B \leqq 7.0 \quad (1)$$

wherein log $M_B$ represents logarithm of the molecular weight or the weight-average molecular weight of (B), and Δ Sp represents the absolute value of the difference of sp value of (A) and Sp value of (B).

11. The composition of claim 10, wherein (A) is at least one resin selected from the group consisting of polyester resin (A1); styrenic, acrylic or methacrylic resin (A2) and epoxy resin (A3).

12. The composition of claim 10, wherein (A) is a polyester resin.

13. The composition of claim 10, wherein (A) is a polystyrene resin, or a styrene/acrylic or methacrylic copolymer.

14. The composition of claim 10, wherein (A) has a Tg of 45°–80° C.

15. The composition of claim 10, wherein (B) is at least one selected from the group consisting of a wax (B1), an oligomer (B2) and a petroleum resin (B3).

16. The exposition of claim 15, wherein (B1) is selected from the group consisting of hydrocarbon wax, fatty acid wax, fatty amide wax, fatty ester wax, fatty alcohol wax urethane wax, oxidized wax ant vinyl-modified wax.

17. The composition of claim 15, wherein (B2) is selected from the group consisting of vinylic oligomer, polyalkylene glycol, polyester oligomer, polyamide oligomer, polyurethane oligomer, phenolic resin oligomer, amino resin oligomer, xylene resin oligomer, ketone resin oligomer, silicone oligomer and fluoro-containing oligomer.

18. The composition of claim 10, wherein the weight ratio of (A) to (B) is 100/0.11–100/30.

19. A method of fixing a toner image by means of a fuser roller, the toner image consisting essentially of a toner which comprises a colorant and the resin composition of claim 1.

20. A method of fixing a toner image by means of a fuser roller, the toner image comprising the toner composition of claim 10.

21. The composition of claim 1, wherein said inequality is within the range of 4.2–6.8.

22. The composition of claim 1, wherein said inequality is within the range of 4.5–6.5.

23. The composition of claim 10, wherein said inequality is within the range of 4.2–6.8.

24. The composition of claim 10, wherein said inequality is within the range of 4.5–6.5.

* * * * *